US005788017A

United States Patent [19]

Wittur et al.

[11] Patent Number: 5,788,017

[45] Date of Patent: Aug. 4, 1998

[54] ELEVATOR HAVING AN ELEVATOR CAGE GUIDED IN RUCKSACK-TYPE MANNER ON A MOUNT FRAME

[75] Inventors: Horst Wittur, Karlsfeld; Hubert Wilhelm Fischer, Munich, both of Germany

[73] Assignee: Wittur Aufzugteil GmbH & Co., Germany

[21] Appl. No.: 539,980

[22] Filed: Oct. 6, 1995

[30] Foreign Application Priority Data

Oct. 10, 1994 [DE] Germany ..... 44 36 088.6

[51] Int. Cl.[6] ..... B66B 11/08

[52] U.S. Cl. ..... 187/266; 187/404

[58] Field of Search ..... 187/404, 405, 187/266, 251, 256, 411, 414

[56] References Cited

U.S. PATENT DOCUMENTS 1,730,974 10/1929 Higber ..... 187/404

1,837,643 12/1931 Anderson ..... 187/404

3,845,842 11/1974 Johnson ..... 187/266

*Primary Examiner*—Kenneth Noland

*Attorney, Agent, or Firm*—Price, Heneveld, Cooper, Dewitt & Litton

[57] ABSTRACT

The subject matter of the patent relates to an elevator with an elevator cage 10 guided in rucksack-type manner on a mount frame and a counterweight 15 connected to said elevator cage through a cable control. Therein two equiaxed rolls 20, 21 are disposed on said counterweight and two rolls 16, 18 parallel to the axes are disposed one beside the other on the upper crossbeam and equal numbers of ropes are guided about one roll each on the counterweight and on the crossbeam, wherein the rope ends acting on the guide section of said elevator cage are defined at the lateral ends of said guide section in symmetry with the central axis of said elevator cage. The individual ropes 25*a*, 25*b*, 26*a*, 26*b*, over their entire lengths run in parallel with one another in one plane within the mount frame 4 guiding said elevator cage 10 and said counterweight 15.

9 Claims, 2 Drawing Sheets

ELEVATOR HAVING AN ELEVATOR CAGE GUIDED IN RUCKSACK-TYPE MANNER ON A MOUNT FRAME

BACKGROUND OF THE INVENTION

The invention relates generally to elevators, and particularly to an elevator having an elevator cage in rucksack-type manner guide on a mount frame in correspondence with patent claim 1.

In a known elevator of this kind (DE 41 31 668 C1), the cable control comprises a stationary roll defined at the mount frame and a loose roll disposed on the counterweight with the free end of the cable control engaging an extension arm or crossbeam of the elevator cage. The ropes of the cable control therein extend perpendicularly between the rolls and the fixation points; however, the axis of the stationary roll lies at an angle to the roll arranged on the counterweight so that mounting of the ropes at the elevator cage is located out of the plane of the mount frame in the area of the shaft and is displaced with respect to the vertical central plane of the elevator cage. In case of an empty or uniformly loaded elevator cage, this results in a force trying to tilt the elevator cage. Furthermore, the ropes running in parallel with one another, of the cable control, are deflected from their common plane in different degrees, causing different tensions in the individual ropes over the entire lift path of the elevator cage. The crossgirder over which the ends of the ropes are fixed on the elevator cage is disposed between the elevator cage and the mount frame and thus reduces the effective depth of the elevator cage.

SUMMARY OF THE INVENTION

It is, therefore, the main object of the present invention to provide an elevator guided in a rucksack-type manner such that the ropes engage the elevator cage symmetrically and all parts required for the hoist and the suspension of the elevator cage are disposed within the depth occupied by the mount frame.

The solution of the object is effected by the features of claim 1. The further claims relate to further preferred embodiments.

In accordance with the present invention, the ropes of the cable control are guided in the mount frame one-half each to the right-hand and left-hand side, respectively, and engage a guide part guided in the plane of the mount frame, of the elevator cage and/or a console, respectively, supporting the latter. The cross-sectional area not occupied by the mount frame, of the elevator shaft, thus remains completely free of parts built in so that also the officially required free space above the elevator cage in the uppermost position thereof requires the lowest structural height possible. The number of energy-dissipating rope deflections therein is the same as in the pertinent prior art, namely two rolls for each individual rope, wherein only the ropes for a symmetrical application of force are divided at the two outside faces of the guide part.

The embodiment of the cable control in accordance with the present invention is particularly suitable for a so-called pull piston drive in which a hydraulic piston pulls the counterweight downwardly for moving the elevator cage upwardly, while the downward movement of the elevator cage is effected due to its own weight which is dimensioned to be correspondingly higher than the weight of the counterweight. The invention can, however, also be used in case of other drive systems.

In the following, the invention is explained in more detail with reference to an embodiment and the drawings.

BRIEF DESCRIPTION OF THE DRAWING FIGURES

DETAIL OF ONE EMBODIMENT OF THE INVENTION

Figure 1:
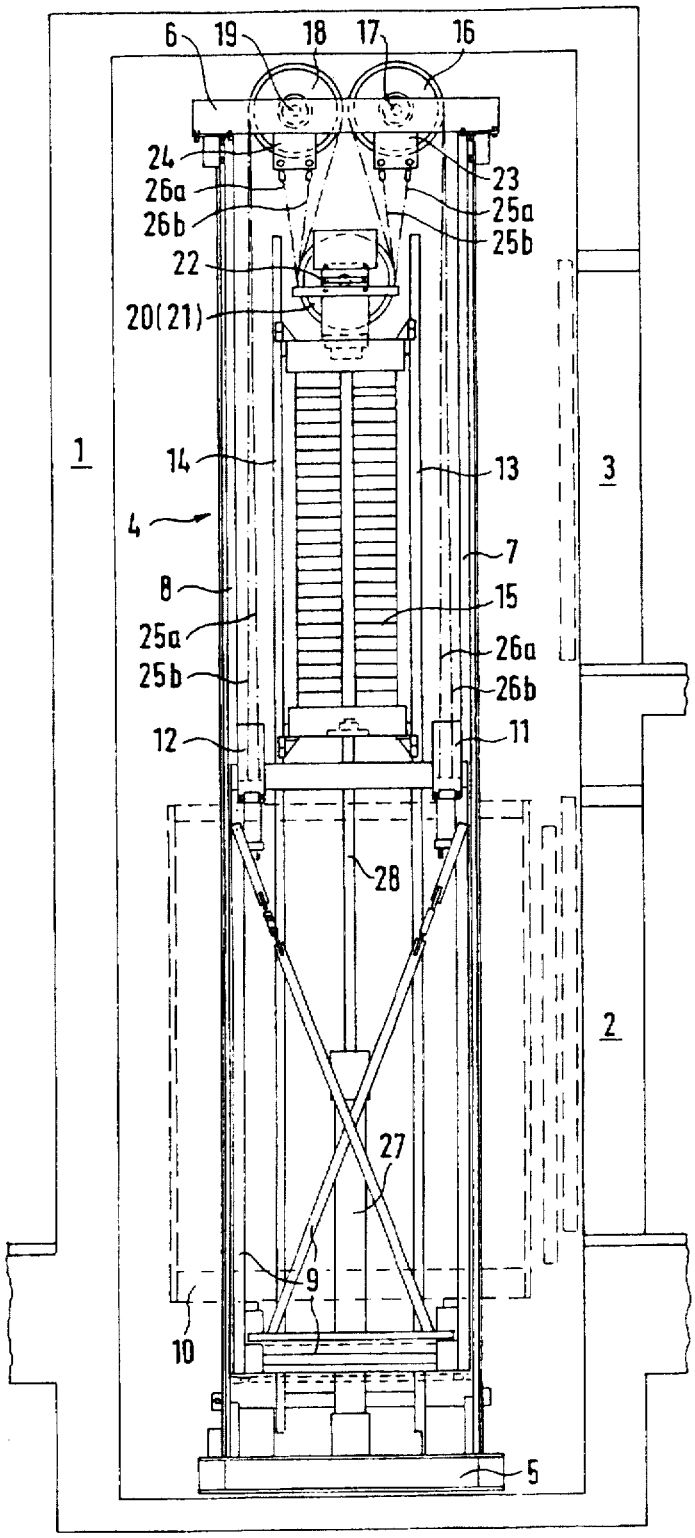
FIG. 1 is a schematical front view of the elevator.

The elevator in accordance with one embodiment of the present invention is intended for use in an elevator shaft 1 in a building. The so-called rucksack-type guiding of the elevator cage therein is accessible from three sides. In FIG. 1, in the right-hand shaft wall at 2 and 3, openings for lateral doors are indicated; identical openings may also be formed in the right-hand and the front walls. For better understanding, in FIG. 1 only two floors are shown, the construction of the present invention, however, not being limited thereto.

A mounting frame 4 in or on which the elevator cage and the counterweight are guided is fixed to the back wall of the elevator shaft 1. The mount frame 4 comprises a lower crossbeam 5, an upper crossbeam 6, and right-hand and left-hand vertical guide rails 7, 8. Further reinforcing and stabilizing parts may be provided, but are not shown or numbered herein.

In the mount frame 4, console 9 is oriented perpendicularly with an elevator cage 10 being seated onto the lower part protruding into the shaft cross-sectional area thereof, and being fixed there, this being shown in FIG. 1 only in dashed lines for better overall view.

The mount frame 4 and the console 9 can be formed as a pre-manufactured structural unit which is installed in an existing elevator shaft as one unit or, in case of greater lifting heights, in matching pieces.

Figure 2:
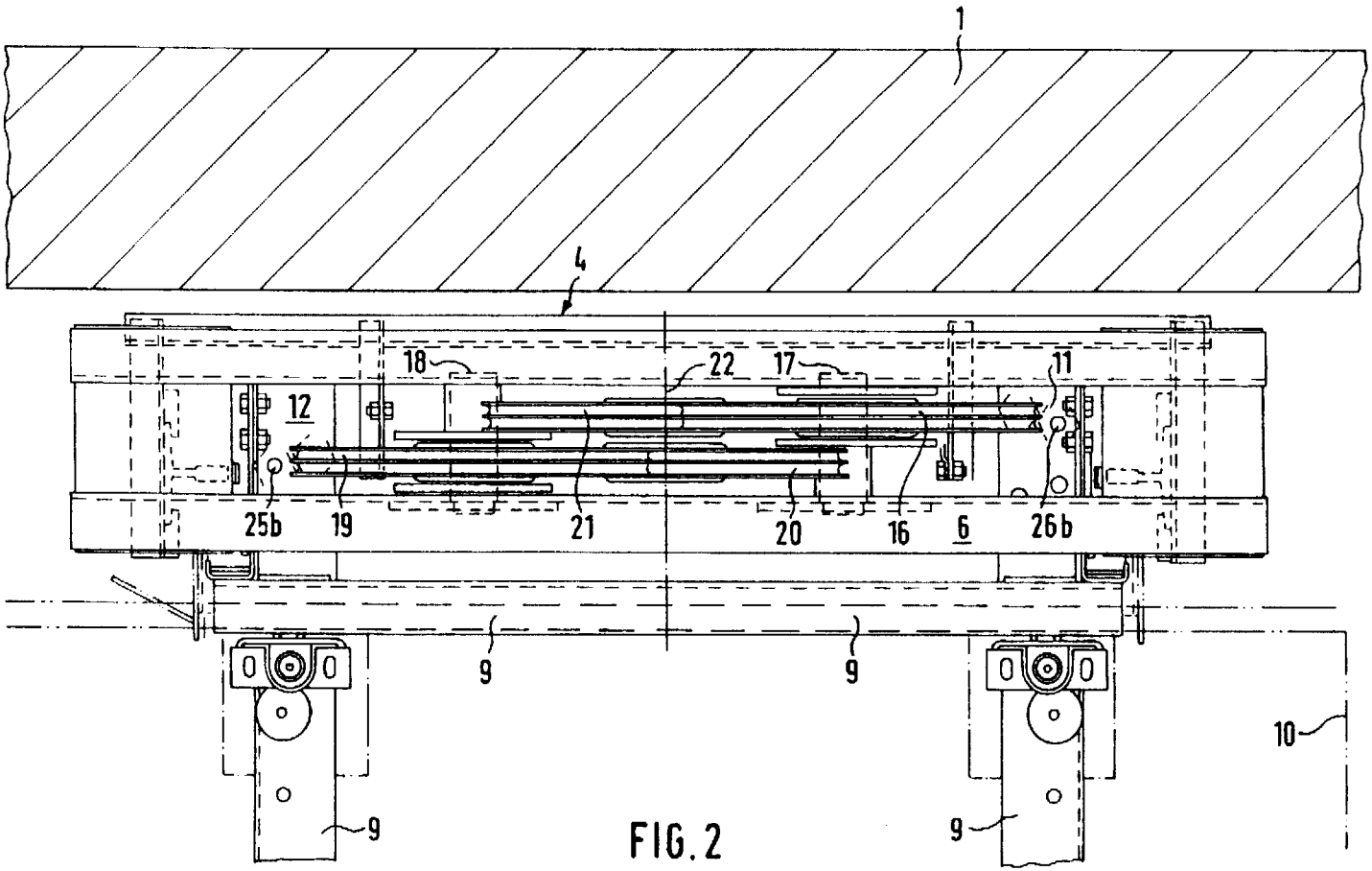
FIG. 2 is a top view onto the mount frame.

The console 9 consists of a vertical frame forming a guide part and shoulders disposed thereon which protrude into said mount frame 4 from backward direction and are guided at said guide rails 7, 8. In FIG. 2 the right-hand upper shoulder is denominated with 11 and the left-hand upper shoulder with 12.

In the mount frame 4, two further guide rails 13, 14 are arranged at a smaller mutual distance than guide rails 7, 8. Guide rails 13, 14 serve for guiding a counterweight 15.

The counteracting movement of console 9 with elevator cage 10 and counterweight 15 is effected by means of a cable control. The cable control in the embodiment shown here includes four individual ropes, but also more or less ropes can be present. It is preferred that there be an even number.

The cable control includes four rolls, each of which serve to deflect two individual ropes and has two rope grooves for this purpose.

On upper crossbeam 6 of mount frame 4, a right-hand roll 16 is rotatable about an axis 17 and a left-hand roll 18 is rotatable about an axis 19. Axes 17 and 19 extend parallel to one another, wherein their distance and the diameter is dimensioned such that the rolls do not overlap. As can be seen from FIG. 2, rolls 16, 18 are mutually displaced in direction of depth of elevator shaft 1.

Two further rolls 20, 21 are supported on the upper side of counterweight 15 on a common axis 22 and are freely rotatable independently from one another. Axis 22 runs parallel to axes 17, 19, and rolls 20, 21 are disposed such that (front) roll 20 lies in one plane with left-hand roll 18 on upper crossbeam 6 and (backward) roll 21 lies in one plane with right-hand roll 16.

On upper crossbeam 6, flanges 23, 24, to which the ends of the individual ropes are fixed, are disposed below rolls 16, 18. From there, the ropes take the following course. The ropes 25*a*, 25*b*, fixed to flange 23, extend to roll 20 lying in a forward position on counterweight 15 and encircle those in the lower area at an angle of about 180° from right to left. From roll 20, ropes 25*a*, 25*b* extend one beside the other to the left-hand upper roll 18 via which they are guided from right to left. Thereafter, ropes 25*a*, 25*b* extend in a downward direction until reaching shoulder 12 of console 9 and are fixed thereto. The other pair of ropes 26*a*, 26*b* extend correspondingly symmetrical from said flange 24 over rolls 21, 16 to shoulder 11.

Physically, this system is a pulley block with two rolls, a fixed one and a loose one, with the loose one taking up the double load after half of the path. To obtain a static balance of forces in accordance therewith, counterweight 15 is preferably twice as heavy as console 9 with elevator cage 10.

In the embodiment described herein, however, counterweight is less heavy than is required for balancing the weight of the empty elevator cage. Herein, a hydraulic cylinder 27, whose piston rod can only be charged with pressure in one direction, i.e., in a downward direction, is arranged below counterweight 15 for movement in an upright position. For moving the elevator in an upward direction, pressure is exerted onto hydraulic cylinder 27 so that counterweight 15 is pulled downwardly and elevator cage 10 is moved upwardly by twice the distance. For downward movement, hydraulic cylinder 27 is relieved from pressure and cage 10 moves in a downward direction due to its own weight; the regulation of speed and load being effected throughout the outlet valve of hydraulic cylinder 27.

It is, however, also possible to use other drive systems, e.g., a motor drive of rolls 16, 18, or 20, 21 in counteracting direction. As well, also a spindle or rack and pinion drive on counterweight 15 is possible.

As can be seen, ropes 25*a*, 25*b* and 26*a*, 26*b* engage symmetrically at the sides of console 9 supporting elevator cage 10, so that even in case of non-uniform load, no lateral tilting forces can occur. The ropes over their entire length and over the entire range of motion run in parallel with one another and in one plane within the cross-sectional area occupied by mount frame 4, whereby the remaining cross-sectional area of the shaft can be used for the elevator cage without restriction.

We claim:

1. An elevator with an elevator cage (10) guided in rucksack-type manner on a mount frame (4), a counterweight (15) guided between the elevator cage guide rails (7, 8) and a cable control whose ropes (25*a*, 25*b*, 26*a*, 26*b*) are fixed with one end in the upper range of the elevator shaft (1), run about a roll located on said counterweight and a further roll disposed at an upper crossbeam (6) of said mount frame and engaging the other end with a guide part of said elevator cage, characterized in that two equi-axial rolls (20, 21) are arranged on said counterweight (15) and two parallel rolls (16, 18) are arranged on the upper cross beam (6) one beside the other, a plurality of ropes is guided about one roll, each on said counterweight and on said crossbeam, and the rope ends engaging the guide part of said elevator cage are fixed at the lateral ends of said guide part symmetrically to the central longitudinal plane of said elevator cage (10).

2. An elevator with an elevator cage (10) guided in rucksack-type manner on a mount frame (4) a counterweight (15) guided between the elevator cage guide rails (7, 8) and a cable control whose ropes (25*a*, 25*b*, 26*a*, 26*b*) are fixed with one end in the upper range of the elevator shaft (1), run about a roll located on said counterweight and a further roll disposed at an upper crossbeam (6) of said mount frame and engaging the other end with a guide part of said elevator cage, characterized in that two equi-axial rolls (20, 21) are arranged on said counterweight (15) and two parallel rolls (16, 18) are arranged on the upper cross beam (6) one beside the other, a plurality of ropes is guided about one roll, each on said counterweight and on said crossbeam, and the rope ends engaging the guide part of said elevator cage are fixed at the lateral ends of said guide part symmetrically to the central longitudinal plane of said elevator cage (10), characterized in that said elevator cage (10) is put onto a console (9) guided in said mount frame (4) and that the ends of said ropes are fixed at the guide part (11,12) guided in said mount frame, of said console.

3. An elevator as defined in claim 2, characterized in that all ropes of said cable control extend in one plane within said mount frame (4).

4. An elevator as defined in claim 3, characterized in that said ropes in said upper region of said elevator shaft (1) are fixed on said crossbeam (6) supporting said rolls (16, 18) below the rolls.

5. An elevator as defined in claim 4, characterized in that in direction of view from the side of said elevator cage (10) onto said mount frame (4) the ropes (25*a*, 25*b*) fixed below the right-hand roll (16) on the upper crossbeam (6) run from right to left about said roll (20) on said counterweight (18), are guided from there over said left-hand roll (18) on said upper crossbeam (6) from right to left and then in downward direction to a shoulder (12) on the left-hand ends of said guide part to which they are fixed with the other ends, and that said ropes (26*a*, 26*b*) fixed below said left-hand roll (19) on said upper crossbeam (6) extend correspondingly side-symmetrically.

6. An elevator as defined in claim 5, characterized in that said rolls (16, 18) on said upper crossbeam (6) have such a diameter and such an axial distance that they do no overlap.

7. An elevator as defined in claim 6, characterized in that said counterweight (15) is less than half as heavy as said elevator cage (10) and, if applicable, said console (9), and that said counterweight engages from bottom with the piston rod (28) of a hydraulic pull cylinder (27).

8. An elevator as defined in claim 6, characterized in that a drive moves the rolls (16, 18) on said upper crossbeam (6) in a counteracting manner.

9. An elevator as defined in claim 6, characterized in that said rolls (20, 21) on said counterweight (15) are driven.

* * * * *